US006853289B2

(12) United States Patent
Scoggin

(10) Patent No.: US 6,853,289 B2
(45) Date of Patent: Feb. 8, 2005

(54) FUSE HANDLE FOR FUSED DISCONNECT SWITCH

(75) Inventor: B. Heath Scoggin, Wildwood, MO (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/254,321

(22) Filed: Sep. 25, 2002

(65) Prior Publication Data

US 2003/0020589 A1 Jan. 30, 2003

Related U.S. Application Data

(63) Continuation-in-part of application No. 09/981,017, filed on Oct. 16, 2001, now Pat. No. 6,784,783.

(60) Provisional application No. 60/242,786, filed on Oct. 24, 2000.

(51) Int. Cl.[7] ..... H01H 85/50; H01H 85/20

(52) U.S. Cl. ..... 337/194; 337/206; 337/255; 361/835; 361/837

(58) Field of Search ..... 337/1–5, 9, 186, 337/194, 206, 208, 142, 242, 245, 255, 265, 167, 266, 241; 361/104, 642, 646, 626, 833, 835, 837

(56) References Cited

U.S. PATENT DOCUMENTS

| | | | | | |
|---|---|---|---|---|---|
| 1,966,716 | A | * | 7/1934 | Green | 337/194 |
| 2,074,863 | A | * | 3/1937 | Sachs | 337/210 |
| 2,186,813 | A | * | 1/1940 | Adam et al. | 337/210 |
| 3,202,788 | A | * | 8/1965 | George | 337/194 |
| 4,107,639 | A | | 8/1978 | Levy | |
| 4,288,138 | A | | 9/1981 | Berry et al. | |
| 4,966,561 | A | * | 10/1990 | Norden | 439/622 |
| 5,052,952 | A | | 10/1991 | Lawson | |
| 5,355,274 | A | * | 10/1994 | Marach et al. | 361/104 |
| 5,515,023 | A | | 5/1996 | Marach et al. | |
| 5,559,489 | A | | 9/1996 | Weiden | |
| 5,559,662 | A | * | 9/1996 | Happ et al. | 361/104 |
| 6,002,580 | A | * | 12/1999 | LeVantine et al. | 361/634 |
| 6,650,222 | B2 | * | 11/2003 | Darr et al. | 337/187 |
| 2002/0067240 | A1 | * | 6/2002 | Darr et al. | 337/187 |

* cited by examiner

*Primary Examiner*—Anatoly Vortman
(74) *Attorney, Agent, or Firm*—Armstrong Teasdale, LLP

(57) ABSTRACT

A fuse comprises a housing assembly, at least one primary fuse link extending within the housing assembly, at least a pair of fuse terminals connected to the primary fuse link and extending from the housing assembly, and a retractable handle assembly coupled to the housing assembly. The handle assists in removal of the fuse from a switch housing assembly.

22 Claims, 13 Drawing Sheets

FUSE HANDLE FOR FUSED DISCONNECT SWITCH

CROSS REFERENCE TO RELATED APPLICATIONS

This application is a continuation in part application of U.S. application Ser. No. 09/981,017 filed Oct. 16, 2001 now U.S. Pat. No. 6,784,783, which claims the benefit of U.S. Provisional Application No. 60/242,786 filed Oct. 24, 2000.

BACKGROUND OF THE INVENTION

This invention relates generally to fused assemblies, and, more particularly, to switchable fuse assemblies.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and open one or more circuits through the fuse to prevent electrical component damage.

In an era of ever-increasing communication services, overcurrent protection of telecommunication systems, such as distribution panels, has become an important issue. While a variety of products, both fuses and circuit breakers, are available to provide overcurrent protection, they exist in a variety of sizes and ratings that often results in an ad hoc assortment of fuses and circuit breakers to protect large, complicated, telecommunications systems. Additionally, capable fuse products exist only with limited mounting and wiring options. The assortment of shapes of overcurrent protection equipment and difficulties in wiring them tends to result in inefficient use of space in limited areas, such as distribution panels, as well as tends to complicate trouble-shooting and maintenance of the system, and also tends to complicate identification of operated fuses and/or tripped devices. As space becomes a premium in a competitive telecommunications industry, a more efficient overcurrent protection device is desired.

One means of efficiently employing a plurality of overcurrent protection devices is the use of a common input bus. Conventional overcurrent protection devices, however, typically include box clamp wiring features that are difficult to use with a line input bus.

BRIEF DESCRIPTION OF THE INVENTION

In one aspect, a fuse is provided. The fuse comprises a housing assembly, at least one primary fuse link extending within said housing assembly, at least a pair of fuse terminals connected to said at least one primary fuse link and extending from said housing assembly, and a retractable handle assembly coupled to said housing assembly.

In another aspect, a fuse is provided. The fuse comprises a housing assembly and a first primary fuse link and a second primary fuse link extending within said housing assembly. Each of the first primary fuse link and said second primary fuse link is coupled to a pair of fuse terminals extending from said housing assembly, and the primary fuse link and the secondary fuse link extend in parallel between each pair of fuse terminals. A handle assembly is coupled to the housing assembly and comprises a handle element and a base element coupled to the housing assembly. The handle element is selectively positionable relative to said base element between a retracted position wherein said handle element is substantially flush with a top surface of said housing assembly and an extended position wherein said handle element is separated from said top surface of said housing assembly.

In another aspect, a fuse is provided. The fuse comprises a first housing, a first primary fuse link extending within said housing, and a pair of fuse terminals associated with said first primary fuse link and extending from said first housing. A second housing, a second primary fuse link extending within said second housing, and a pair of fuse terminals associated with said second primary fuse link and extending from said second housing is also provided, and a handle assembly extends between and is coupled to said first housing and to said second housing.

In another aspect, a fused disconnect switch is provided. The disconnect switch comprises at least one switch housing assembly comprising a fuse receptacle and a plurality of fuse terminal contact assemblies extending therefrom, at least one of said plurality of fuse contact assemblies comprising a bullet contact assembly, and a retractable fuse comprising a housing comprising at least one primary fuse link extending therein and at least one handle element attached thereto.

In still another aspect, a fused disconnect switch is provided. The disconnect switch comprises a switch housing comprising a fuse receptacle, first and second line-side contact assemblies extending from said fuse receptacle, and first and second load-side contact assemblies extending from said fuse receptacle; and a fuse comprising a housing assembly, a first primary fuse link extending between said first line-side contact assembly and said first load-side contact assembly and a second primary fuse link extending between said second line-side contact assembly and said second load-side contact assembly, and a retractable handle element coupled to said fuse housing assembly.

DETAILED DESCRIPTION OF THE INVENTION

Figure 1:
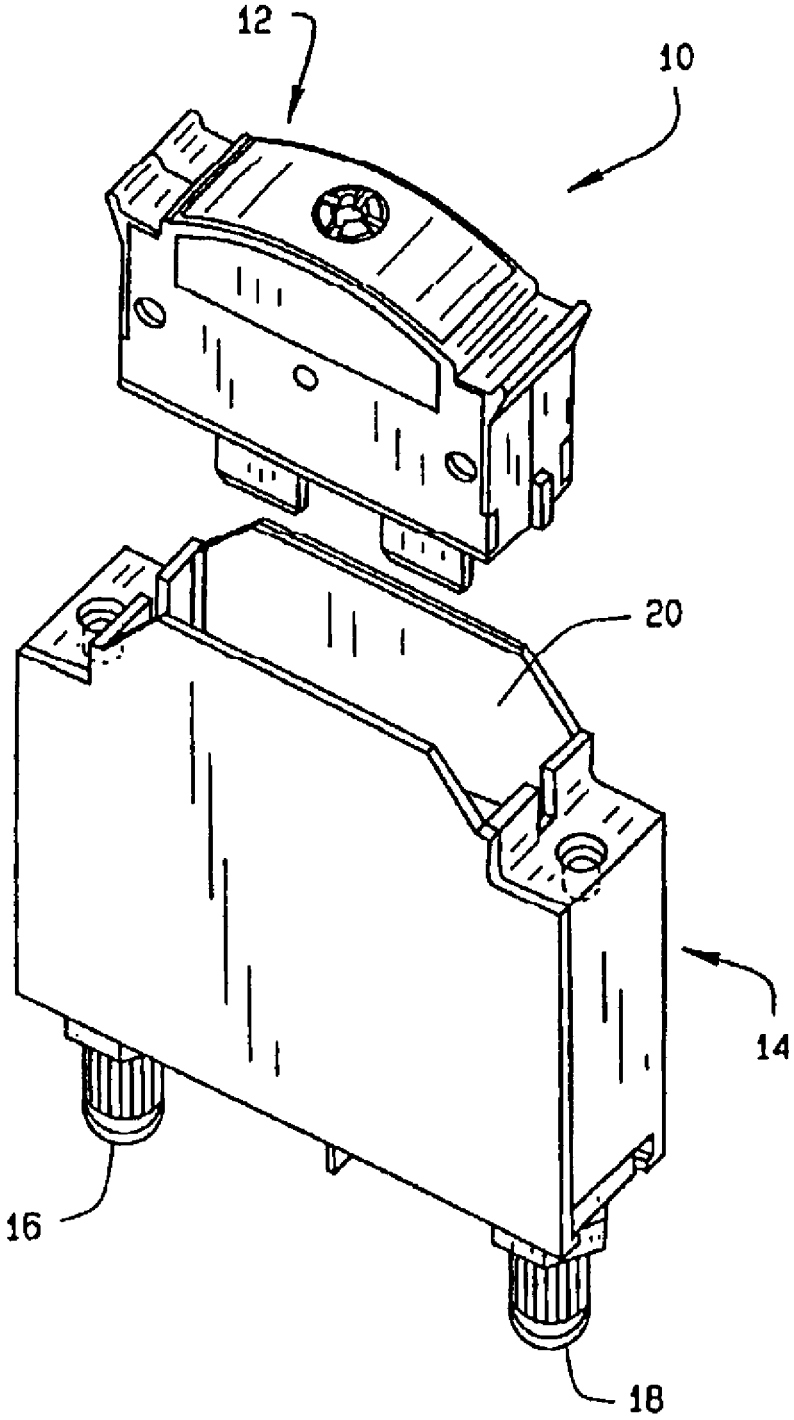
FIG. 1 is an exploded perspective view of a fused disconnect switch assembly.

FIG. 1 is an exploded perspective view of a fused disconnect switch assembly 10 including a fuse 12 for removable engagement with a switch housing assembly 14. Switch housing assembly 14 includes a first bullet contact assembly 16 for plug in connection to a line input bus (not shown) and a second bullet contact assembly 18 for plug in connection to load side equipment (not shown), such as a distribution panel. When fuse 12 is fully inserted into a switch housing assembly fuse receptacle 20, an electrical circuit is completed through fuse 12 via first and second bullet contact assemblies 16, 18. As such, fused disconnect switch assembly 10 is ideally suited, in an exemplary embodiment, for protecting telecommunications equipment from damaging fault currents as well as facilitating disconnection of the load by extraction of fuse 12 from switch housing assembly 14. It is understood, however, that the benefits of the present invention accrue generally to many fused systems, and the present invention is in no way intended to be restricted to any particular use or application.

Figure 2:
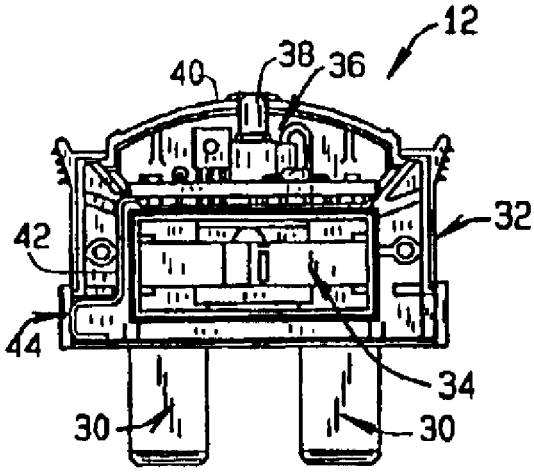
FIG. 2 is a cross-sectional view of the fuse shown in FIG. 1.

FIG. 2 is a cross-sectional view of fuse 12 (shown in FIG. 1) including first and second fuse terminals 30 extending from a fuse housing 32 and in electrical communication with a primary fuse link 34 mounted in fuse housing 32 and extending between first and second terminals 30. When an electrical circuit is completed through fuse terminals 30, current flows through primary fuse link 34, and as current flowing through primary fuse link 34 approaches a predetermined threshold, i.e., a fault current, primary fuse link 34 melts, vaporizes or otherwise opens and prevents electrical current from flowing therethrough. Thus, an open circuit is created between fuse terminals 30 and associated load-side electrical components and circuits are isolated by fuse 12 and thereby protected from damaging fault currents. An arc-quenching material (not shown), such as silica sand, may surround primary fuse link 34 within housing 32 to prevent and/or suppress arcing between fuse terminals 30 when primary fuse link 34 opens.

In one embodiment, primary fuse link 34 is fabricated so that fuse 12 has a rating of 25 to 125 amps and a safety interrupt of 100 kA at 80Vdc. In addition, different fuse ratings are obtained with differently fabricated primary fused links 34 inside fuse housing 32 so that differently rated fuses have substantially the same size and shape, or footprint, so that a variety of different fuses may be employed with a single switch housing assembly for versatility in the field. It is contemplated, however, that the benefits of the present invention accrue to a wide variety of fused systems employing fuses of different ratings, shapes, and sizes. Therefore, the specific embodiments illustrated and described herein are for illustrative purposes only and are not intended to limit the invention in any aspect.

Fuse 12 also includes a local and remote open-fuse indication device 36 for indicating an operational state of fuse 12. In one embodiment, device 36 includes a high resistance electronic circuit, explained in detail below, that illuminates a light emitting diode ("LED") 38 when primary fuse link 34 is opened. LED 38 is visible through a top 40 of fuse housing 32 and, when illuminated, readily identifies an operated fuse for replacement. When employed in electrical systems with a large number of fuses, local fuse state indication via LED 38 is a significant advantage over conventional fuses.

In an alternative embodiment, open-fuse indication device 36 includes a secondary fuse link (not shown in FIG. 2) electrically connected between fuse terminals 30 in parallel with primary fuse link 34. The secondary fuse link has a much greater electrical resistance than primary fuse link 34 so that when fuse 12 is operational, i.e., when primary fuse link 34 has not opened, substantially all the current flowing through fuse 12 passes through primary fuse link 34. However, when primary fuse link 34 opens and the circuit is broken through primary fuse link 34, current flows through the secondary fuse link and triggers an electronic or mechanical indicator for local indication of the opened fuse via visual observation of fuse housing 32.

In further alternative embodiments, other known electrical, mechanical, or electromechanical devices are used to visibly indicate an operational state of fuse 12 for local fuse state indication.

Open fuse indication device 36 further includes an electrically conductive alarm terminal 42 protruding through an opening 44 in fuse housing 32. When fuse terminal alarm 42 is coupled to a resistive load, such as a relay coil (not shown) typically found in existing telecommunications equipment, a signal is sent to the relay coil when primary fuse link 34 has opened, thereby directing attention to a particular location where an opened fuse is located. Local fuse state indication identifies the open fuse or fuses in the specified location. Thus, opened fuses may be efficiently located even when large numbers of fuses in various locations are employed.

Figure 3:
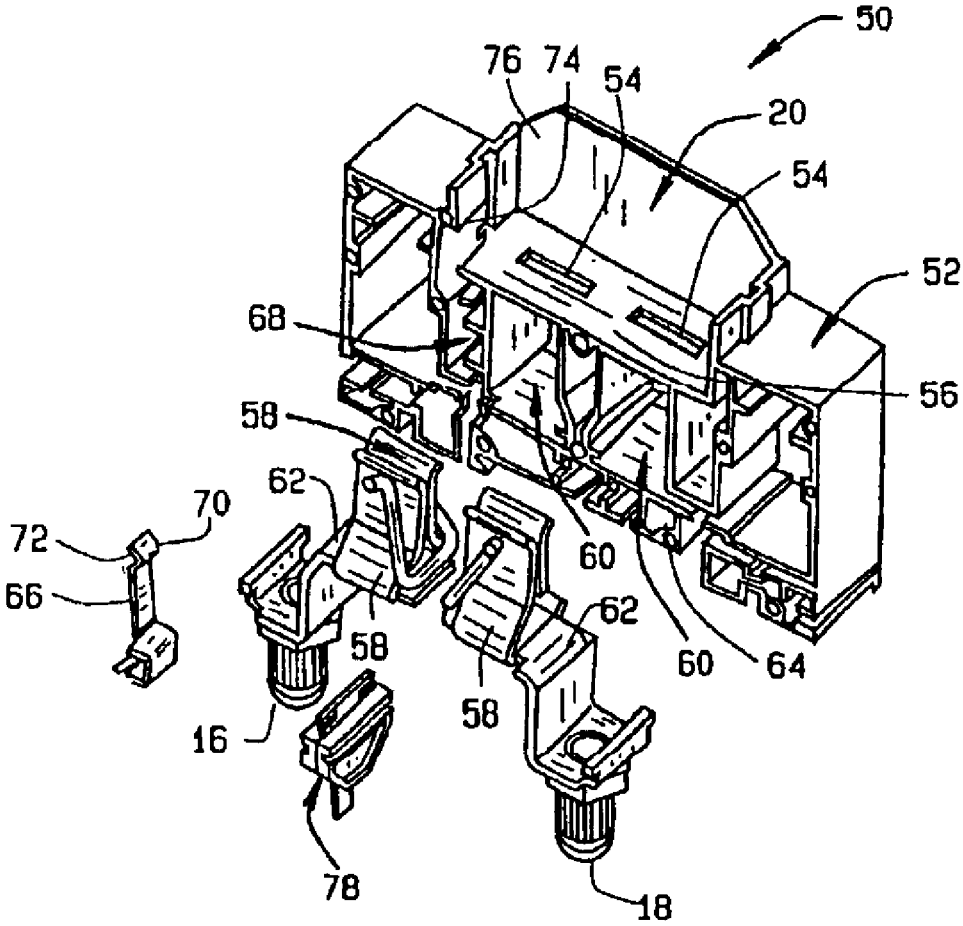
FIG. 3 is a perspective assembly view of a switch housing assembly.
Figure 4:
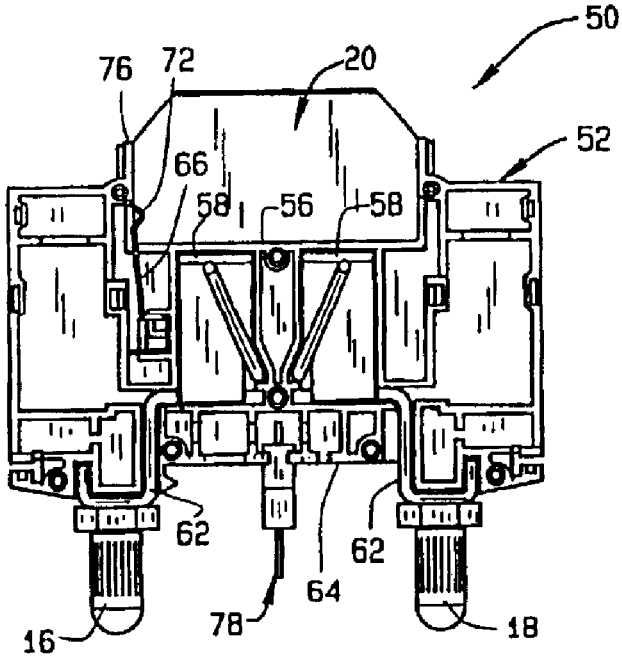
FIG. 4 is a side elevational view with parts removed of the switch housing assembly shown in FIG. 3.

FIGS. 3 and 4 illustrate a first embodiment of switch housing assembly 50 including a housing 52 having fuse terminal openings 54 in a bottom 56 of fuse receptacle 20 for receiving fuse terminal blades 30 (shown in FIG. 2). An electrically conductive resilient clip 58 is located below each fuse terminal opening 54 and located in a cavity 60 below fuse receptacle 20. A bridge portion 62 extends downwardly from each clip 58 and to electrically conductive bullet contact assemblies 16, 18 for connection to either a line input bus (not shown) or a load bus (not shown). When fuse terminals 30 are inserted through fuse terminal openings 54, fuse terminals 30 are received in clips 58 and thus are electrically coupled to bullet contact assemblies 16, 18 protruding through a bottom 64 of housing 52.

A switch housing internal alarm terminal 66 is positioned adjacent one of fuse clips 58 within an adjacent cavity 68, and includes a projecting ridge 70 at a top end 72 that protrudes through an opening 74 in a side wall 76 of fuse receptacle 20. Thus, when fuse 12 is fully inserted into fuse receptacle 20, alarm terminal projecting ridge 70 contacts fuse alarm terminal 42 (shown in FIG. 2) through housing opening 44 (shown in FIG. 2). Internal alarm terminal 66 is further coupled to a remote output alarm terminal 78 that extends though a bottom 64 of switch housing 52, thereby completing an electrical path for an open fuse alarm signal for transmission to end use equipment (not shown) during an open fuse condition.

A fused disconnect switch assembly 10 (shown in FIG. 1) is therefore provided that facilitates installation to existing equipment without auxiliary components or hand wired connections. Switching is achieved by inserting or extracting fuse 12 from switch housing fuse receptacle 20, and local and remote opened fuse indication provides ready indication of opened fuses for replacement. Because a variety of differently rated fuses are accommodated by switch housing receptacle 20, a versatile fused disconnect assembly 10 is provided that is suitable for a wide variety of applications.

Figure 5:
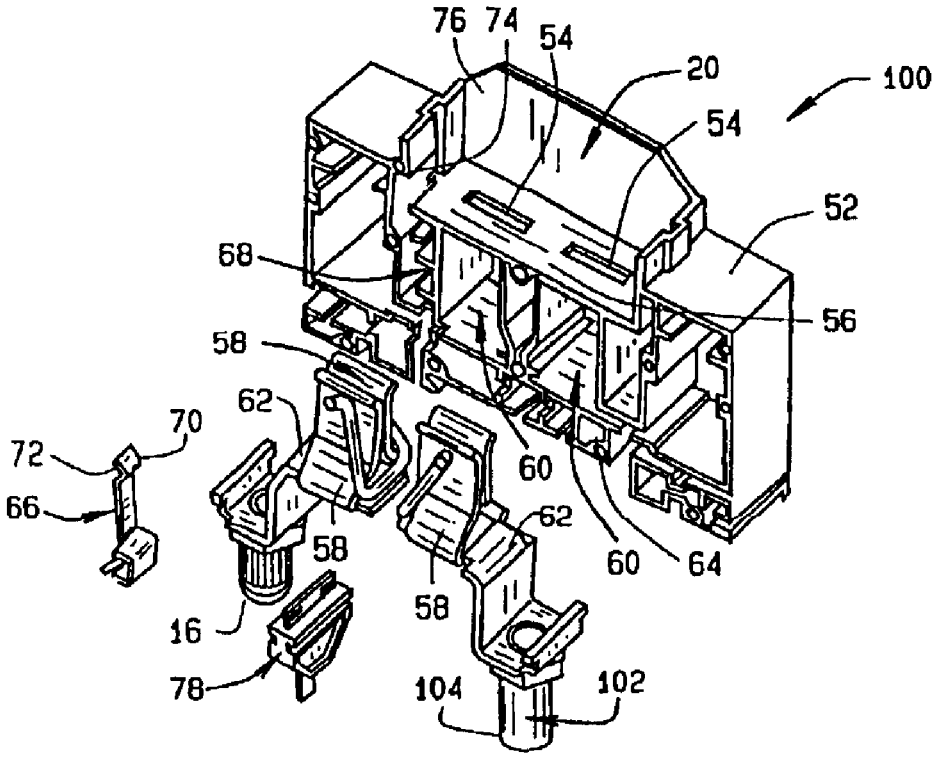
FIG. 5 is a perspective assembly view of a second embodiment of a switch housing assembly.

FIG. 5 illustrates a second embodiment of a switch housing assembly 100 in which common features of switch housing assembly 50 (shown in FIGS. 3 and 4) are referenced with like reference characters. Switch housing assembly 100 is configured for use with a removable fuse, such as fuse 12 (shown in FIGS. 1 and 2). Unlike switch housing assemblies 50, switch housing assembly 100 includes a terminal stud assembly 102 in lieu of bullet contact assembly 18. Terminal stud contact assembly 102 includes a bridge portion 62 extending downwardly from electrically conductive clip 58. Terminal stud contact assembly 102, in one embodiment, is fabricated from steel and attached to bridge portion 62, while in an alternative embodiment terminal stud contact assembly may be integrally formed with bridge portion 62. Terminal stud 102 contact assembly includes threads (not shown) on a lower portion 104 for mounting switch housing assembly 100 within the end use application, such as for example, with a nut or other threaded fastener (not shown). Thus, switch assembly 100 includes one bullet contact assembly 16 and one terminal stud contact assembly 102 for line and load side electrical connections in the end use application.

Therefore, a fused disconnect switch housing 100 is provided that facilitates installation to existing equipment without auxiliary components or hand wired connections with at least two mounting options. Switching is achieved by inserting or extracting a fuse, such as fuse 12, from switch housing receptacle 20, and local and remote opened fuse indication provides ready indication of opened fuses for replacement. Because a variety of differently rated fuses are accommodated by switch housing receptacle 20, a versatile fused disconnect system is provided that is suitable for a wide variety of applications.

Figure 6:
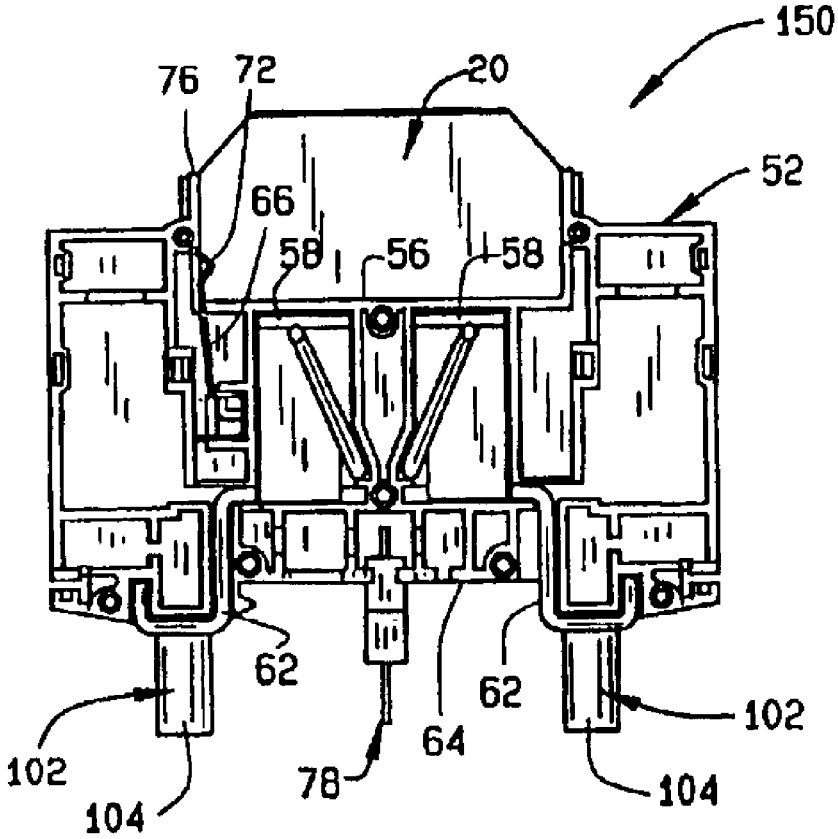
FIG. 6 is a side elevational view of a third embodiment of a switch housing assembly.

FIG. 6 illustrates a third embodiment of a switch housing assembly 150 in which common features of switch housing assembly 50 (shown in FIGS. 3 and 4) and switch housing assembly 100 (shown in FIG. 5) are referenced with like reference characters. Switch housing assembly 150 is configured for use with a removable fuse, such as fuse 12 (shown in FIGS. 1 and 2). Unlike switch housing assembly 50 and 100, switch housing assembly 150 includes first and second terminal stud assemblies 102 in lieu of bullet contact assemblies 16, 18 (shown in FIGS. 1, 3, and 4). Each terminal stud contact assembly 102 includes a bridge portion 62 extending downwardly from electrically conductive clip 58. Terminal stud contact assembles 102, in one embodiment, are fabricated from steel and attached to bridge portions 62. In another embodiment, terminal stud contact assemblies 102 are each integrally formed with bridge portions 62 from an electrically conductive material. Each terminal stud contact assembly 102 includes threads (not shown) on a lower portion 104 for mounting switch housing assembly 150 within the end use application, such as for example, with a nut or other threaded fastener (not shown). Thus, switch assembly 150 includes two terminal stud contact assemblies 102 for line and load side electrical connections in the end use application.

Therefore, a fused disconnect switch housing 150 is provided that facilitates installation to existing equipment without auxiliary components or hand wired connections. Switching is achieved by inserting or extracting a fuse, such as fuse 12, from switch housing receptacle 20, and local and remote opened fuse indication provides ready indication of opened fuses for replacement. Because a variety of differently rated fuses are accommodated by switch housing receptacle 20, a versatile fused disconnect system is provided that is suitable for a wide variety of applications.

Figure 7:
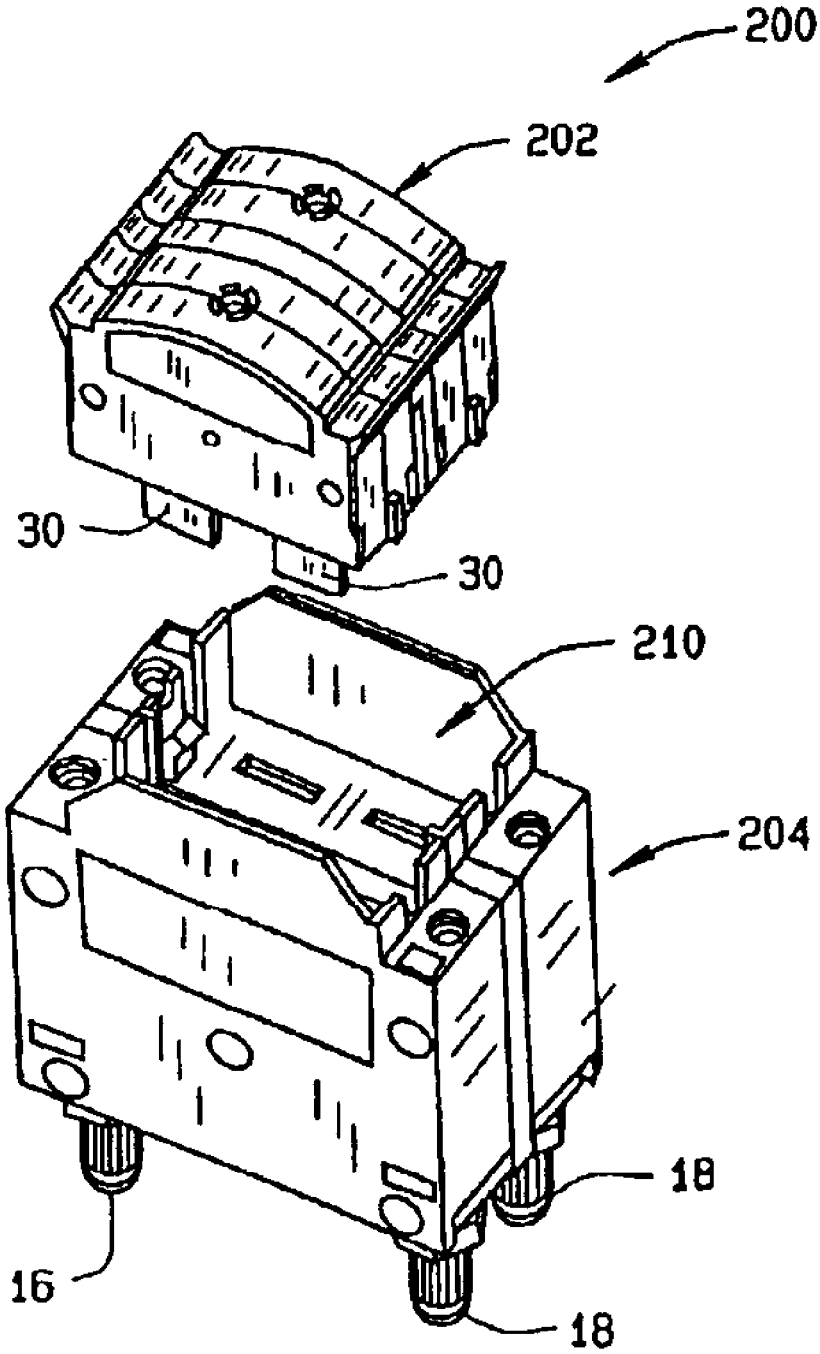
FIG. 7 is a perspective assembly view of a fourth embodiment of a switch housing assembly.

FIG. 7 illustrates a fourth embodiment of a fused disconnect switch assembly 200 configured for higher current applications than the foregoing embodiments, but still maintaining a common footprint. Common features of switch housing assembly 50 (shown in FIGS. 3 and 4), switch housing assembly 100 (shown in FIG. 5), and switch housing assembly 150 (shown in FIG. 6) are referenced with like reference characters.

Assembly 200 is essentially a double-wide version of fused disconnect assembly 10 (shown in FIG. 1) and includes a fuse 202 for removable engagement with a switch housing 204. In other words, the construction and operation of fuse 202 and switch housing assembly 204 is substantially similar to that described above in relation to FIGS. 1–3 with the exception that assembly 200 includes two line-side bullet contact assemblies (only one of which is shown in FIG. 7) and two load-side bullet contact assemblies 18 for plug in connection to, for example, a line input bus (not shown) and load-side equipment (not shown), respectively. Likewise, fuse 202 includes four male terminal contacts 30 (only two of which are visible in FIG. 7) received in fuse terminal openings (not shown in FIG. 7) in a bottom of a fuse receptacle 210.

When fuse 202 is inserted into fuse receptacle 210, and further when bullet contact assemblies 16, 18 are coupled to line side and load equipment, first and second fused circuits are established in parallel through fuse 202 between each pair of bullet contact assemblies 16 and 18. The load may be disconnected by extraction of fuse 202 from switch housing assembly 204.

In one embodiment, and as explained further below, fuse 202 includes a first fuse link (not shown in FIG. 7) and a secondary fuse link (not shown in FIG. 7) extending between each pair of fuse terminal contacts 30 such that the fuse links extend electrically in parallel to one another. Local fuse state indication via LED 38 (shown in FIG. 2) and remote opened fuse state indication via fuse alarm terminal 42 (shown in FIG. 2) are employed with the parallel fuse links for local and remote fuse state indication, respectively. The primary fuse links are fabricated so that fuse 202 has a combined rating of 130 to 250 amps and a safety interrupt of 100 kA at 80Vdc.

It is recognized that system 200 could be further extended to obtain even greater amperage ratings, e.g., a triple-wide fuse and switch housing assembly could be employed.

Figure 8:
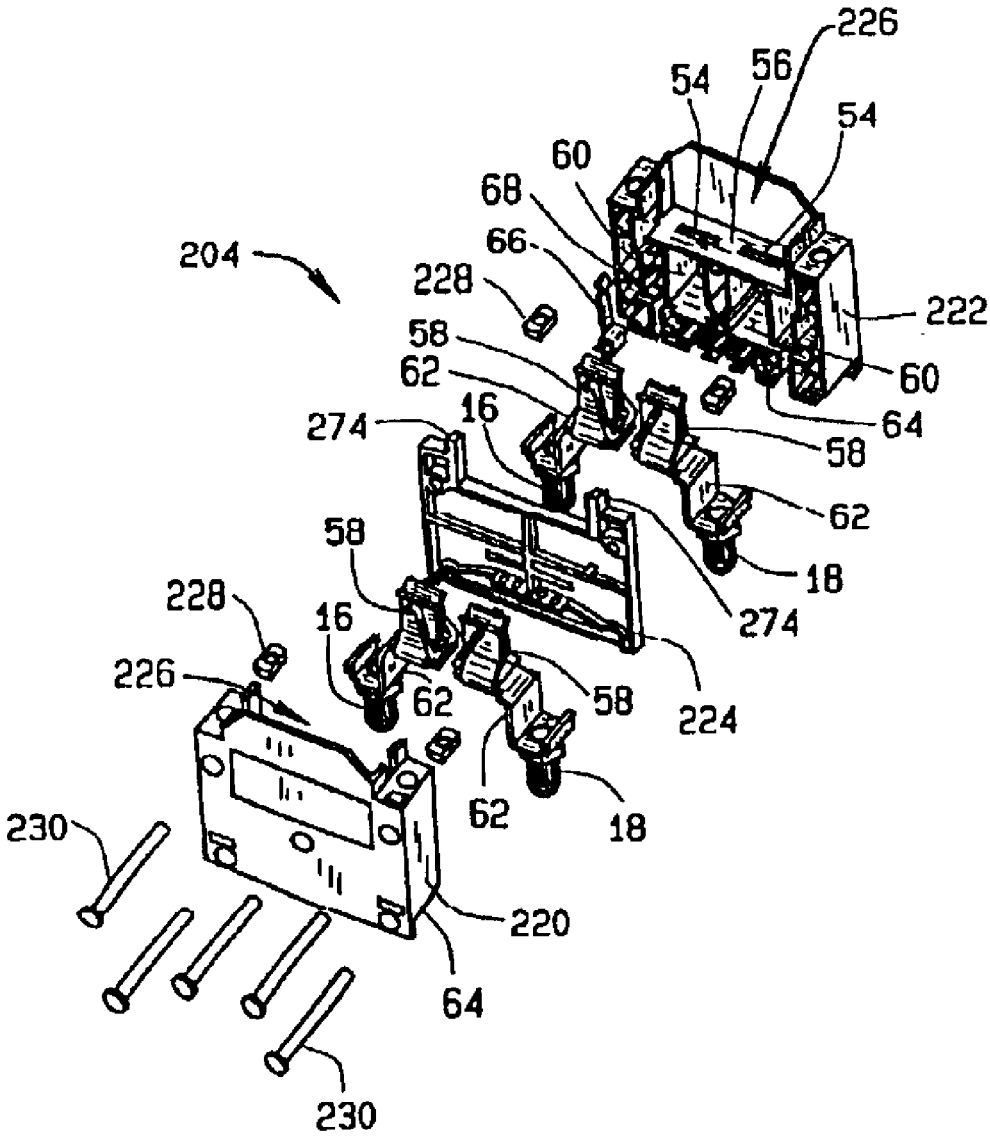
FIG. 8 is an exploded view of the switch housing assembly shown in FIG. 7.

FIG. 8 is an exploded view of a switch housing assembly 204 including substantially identical front and rear housings 220, 222 and a spacer element 224 located therebetween. Each housing 220, 222 includes fuse terminal openings 54 in a bottom 56 of a fuse receptacle 226 that forms approximately one half of fuse receptacle 210 (shown in FIG. 7) for receiving fuse terminal blades 30 (shown in FIG. 7). Electrically conductive resilient clips 58 are located below each fuse terminal opening 54 and located in cavities 60 below fuse receptacle 226. Bridge portions 62 extend downwardly from each clip 58 and to electrically conductive bullet contact assemblies 16, 18 for connection to either a line input bus (not shown) or a load bus (not shown). When fuse terminals 30 (shown in FIG. 1) are inserted through fuse terminal openings 54, fuse terminals 30 are received in clips 58 and thus are electrically coupled to bullet contact assemblies 16, 18 protruding through a bottom 64 of housings 220 and 222.

Switch housing internal alarm terminal 66 is positioned adjacent one of fuse clips 58 within an adjacent cavity 68 in housing 222, and includes a projecting ridge 70 (shown in FIG. 3) at a top end 72 (also shown in FIG. 3) that protrudes through an opening 74 (as shown in FIG. 3) in a side wall 76 (see FIG. 3) of fuse receptacle 226. Thus, when fuse 202 (shown in FIG. 7) is fully inserted into fuse receptacle 210 (shown in FIG. 7), jointly formed by receptacles 226 of each housing 220, 222, alarm terminal projecting ridge 70 contacts fuse alarm terminal 42 (shown in FIG. 2) through housing opening 44 (shown in FIG. 2). Internal alarm terminal 66 is further coupled to a remote output alarm terminal (not shown in FIG. 8 but similar to terminal 78 shown in FIG. 3) that extends though a bottom 64 of switch housing 220 and 222, thereby completing an electrical path for an open fuse alarm signal for transmission to end use equipment (not shown) during an open fuse condition.

Mounting footings 228 are provided in each housing 220, 222 adjacent fuse receptacles 226, and known fasteners 230 are extended through openings in housings 220, 222 and spacer element 224 to secure assembly 204 in an assembled condition as shown in FIG. 7.

Figure 9:
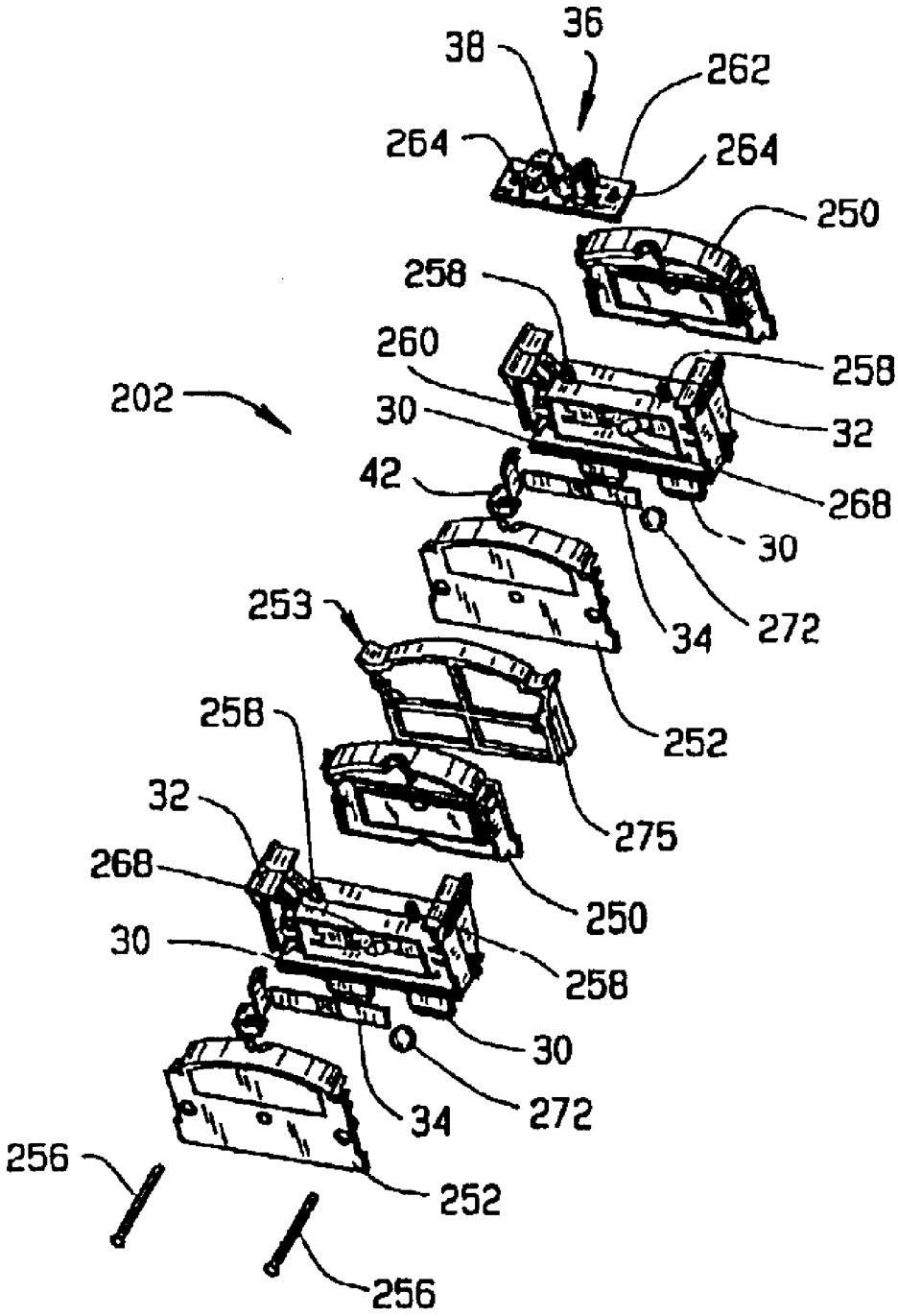
FIG. 9 is an exploded view of the fuse shown in FIG. 7.

FIG. 9 is an exploded view of fuse 202 wherein like features of fuse 12 (shown in FIGS. 1 and 2) are designated with like reference characters.

Fuse 202 includes two pairs of opposite front and back covers 250, 252, separated by a spacer element 253 and attached to one another according to known methods and techniques, including but not limited to rivets 256 and screws (not shown), adhesive processes and ultrasonic welding processes. Disposed between each pair of front and back covers 250, 252 is a fuse housing 32. A pair of fuse terminals 30 extend from each of two fuse housings 32, and a primary fuse link 34 is electrically coupled to each pair of fuse terminals 30. Fuse links 34 extend in parallel with one another across respective pairs of fuse terminals 30, one terminal forming a line-side electrical connection and the other terminal forming a load-side electrical connection.

As illustrated in FIG. 9, each fuse link 34 is a substantially flat and generally linear conductive strip including an area of reduced cross section, or a weak spot therein. Upon an occurrence of a predetermined current fault condition, dependent upon dimensions and characteristics of fuse link 34, the weak spot reaches an operating temperature sufficient to melt, disintegrate, vaporize, decompose, or otherwise open fuse links 34 at or near the weak spot to break an electrical connection through fuse links 34. It is contemplated, however, that a variety of fuse elements may be employed in alternative embodiments in lieu of the illustrative fuse links 34 without departing from the scope of the present invention. For instance, non-linear (e.g., bent or curved) fuse elements, fuse elements including a plurality of weak spots, and wire fuse elements without weak spots, in addition to other fuse elements familiar to those in the art, may be likewise employed in the present invention. Additionally, in one embodiment, primary fuse links 34 are fabricated so that when connected in parallel fuse 202 has a combined rating of 130 to 250 amps and a safety interrupt of 100 kA at 80Vdc. It is appreciated, however, that in alternative embodiments, fuse links 34 may be constructed to meet other performance objectives.

In an alternative embodiment, common line-side terminals 30 and common load-side terminals 30 are employed by electrically coupling respective terminals 30 of each housing 32. Thus, for example, a U-shaped line contact terminal may be employed with the legs of the U extending through a bottom of fuse housings 32 and a U-shaped load contact terminal may be employed with the legs of the U extending through a bottom of fuse housings 32. Primary fuse links 34 may then be extended between a leg of the line terminal and a leg of the load terminal within each of fuse housings 32.

Terminal posts 258 extend through a top surface of fuse housings 32 for establishing an electrical connection to open circuit indication device 36. Alarm terminal 42 is fitted within a compartment 260 of one of housings 258 and also is established in electrical communication with open circuit indication device 36.

Open fuse indication device 36 includes a printed circuit board 262 including apertures 264 for electrical connection to terminal posts 258 that are in turn, coupled to fuse terminals 30 for establishing line and load electrical connections to external circuitry (not shown). Printed circuit board 262 includes high resistance electronic circuitry, explained below, that operates LED 38 in response to a voltage drop across terminal posts 258 when primary fuse links 34 melt, disintegrates, vaporizes or otherwise opens and breaks an electrical connection between fuse terminals 30 via fuse links 34. As such, LED 38 is illuminated when fuse links 34 operate, thereby providing local fuse state indication. Circuitry on printed circuit board 264 also signals external equipment, such as a relay in a telecommunications system, through alarm terminal 42 and associated alarm terminals of a switch housing assembly such as assembly 204 (shown in FIG. 8).

LED 38 protrudes through an opening in one of fuse housings 32 so that fuse state indication is readily ascertainable from visual inspection of LED 38. If LED 38 is not illuminated, fuse 202 is functional, i.e., fuse links 34 have not opened due to fault current conditions. On the other hand, if LED 38 is illuminated, fuse 202 has operated and should be replaced with a functional fuse.

Fuse housings 32 each further include an opening 268 extending through bottom of fuse housing 32 to facilitate introduction of an arc quenching media, such as silica sand, to surround terminals 30 and fuse link 34 within each housing 32. The arc quenching media prevents and/or suppresses arcing between fuse terminals 30 when fuse links 34 open. A plug 272 is inserted into each opening 268 after fuse housings 32 are filled with the arc quenching media to seal fuse 202. In an exemplary embodiment, plug 272 is ball fabricated from nylon or other suitable materials and applied to opening 268 according to known techniques.

Additionally, a polarization projection 274 extends from each side of spacer element 224 (shown in FIG. 8) and projection 274 is received in complementary grooves 275 formed into each lateral side of fuse spacer element 253. Projection 274 prevents insertion of fuse 202 into fuse receptacle 210 except in a designated orientation when projections 274 are inserted into groove 275. Thus, correct polarization of the fuse terminals is ensured with respect to associated line and load connections with the applicable switch housing assembly.

Fuse 202 in combination with switch housing assembly 204 (shown in FIG. 8) provides a fused disconnect assembly 200 (shown in FIG. 7) that facilitates installation to existing equipment without auxiliary components or hand wired connections and is capable of higher current protection than assembly 10 (shown in FIG. 1). Switching is achieved by inserting or extracting fuse 202 from switch housing fuse receptacle 210 (shown in FIG. 7), and local and remote opened fuse indication provides ready indication of opened fuses for replacement. Because a variety of differently rated fuses are accommodated by switch housing receptacle 210, a versatile fused disconnect system is provided that is suitable for a wide variety of applications.

Figure 10:
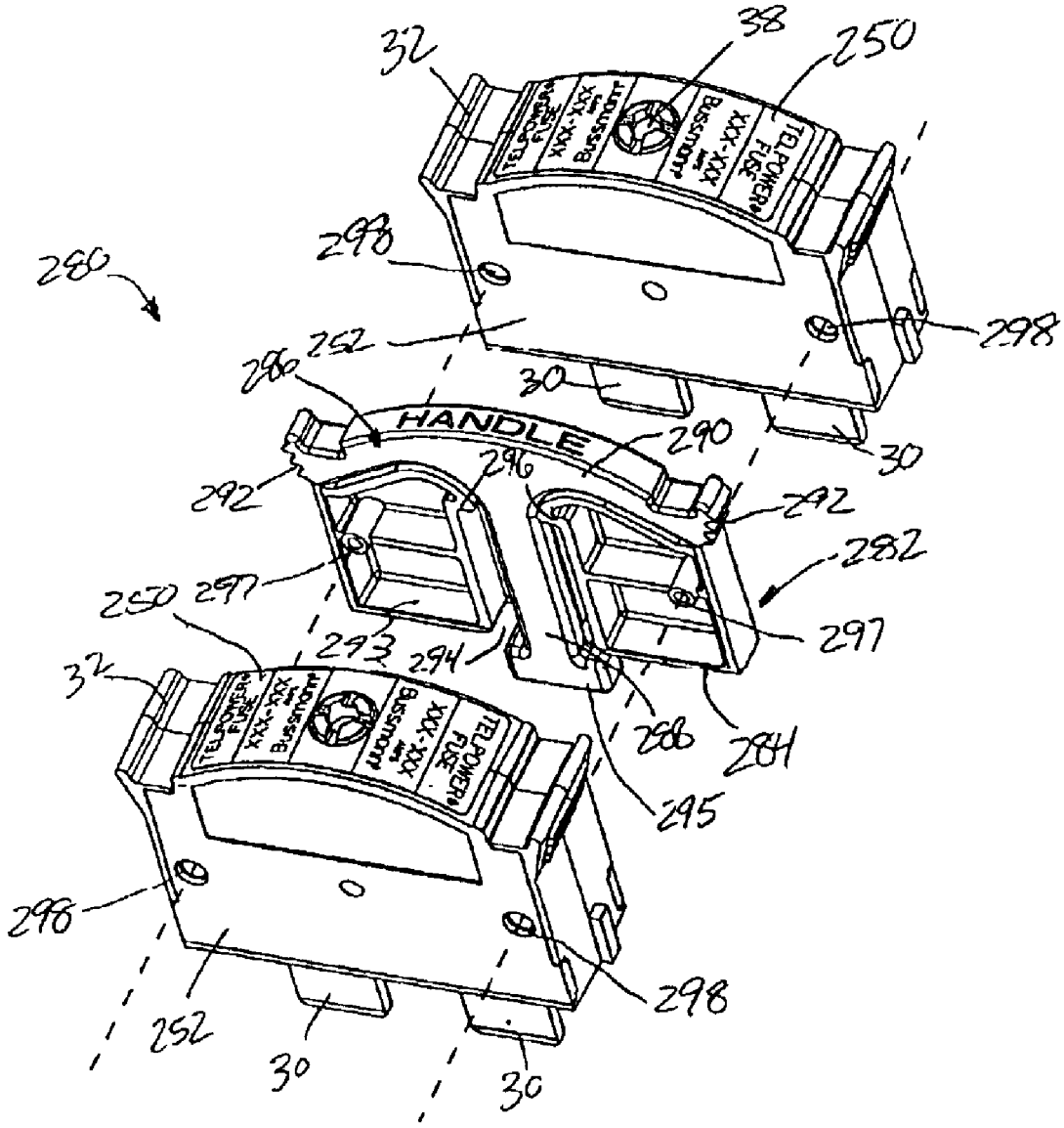
FIG. 10 is an exploded assembly view of another embodiment of the fuse shown in FIG. 9 including a retractable handle.

FIG. 10 is an exploded assembly view of an another exemplary embodiment of a fuse 280 for use with, for example, switch housing 204 (shown in FIG. 7). Common features of fuse 202 (shown in FIG. 9) and fuse 280 are referenced with like reference characters.

Fuse 280 is constructed substantially similar to fuse 202 in that first and second fuse housings 32 each include fuse terminals 32 and primary fuse links 34 (shown in FIG. 9) that are connected in parallel to one another when fuse 280 is employed with a switch housing. Unlike fuse 202 that includes spacer element 253 (shown in FIG. 9) between fuse housings 32, fuse 280 includes a handle section 282 that serves both to space first and second fuse housing 32 from one another and to facilitate removal of fuse 280 from a switch housing, such as switch housing 204 (shown in FIG. 7). Because fuse 280 includes two blade-type terminals 30 extending from each housing 32 between respective primary fuse links 34 (one terminal forming a line-side electrical connection and the other terminal forming a load-side electrical connection) four terminals 30 are engaged by a switch housing in use. Engagement of four fuse terminals 30 with the switch housing may tend to make fuse 280 difficult to remove or extract from the switch housing, and handle section 282 provides an extraction tool for easy removal of fuse 280 and disconnection of a circuit through the associated switch housing, such as switch housing 204.

In an illustrative embodiment, handle section 282 includes a base spacer element 284 and a retractable handle element 286 selectively positionable between a closed or retracted position (shown in FIG. 10) relative to base element 284 and an open or extended position (explained below). Handle element 286 includes a longitudinally extending central support member 288 and a curved gripping member 290 extending above central support member and extending laterally outwardly from central support member 288. Handle gripping member 290 includes gripping ridges 292 on opposite distal ends thereof to assist in extending handle element 286 from its closed or retracted position. In the illustrated embodiment, curved gripping member 290 extending atop a generally straight support member 288 provides handle element 286 with an overall shape reminiscent of an anchor. It is appreciated, however, that a variety of alternative shapes of handle element 286 may be likewise employed in various alternative embodiments while obtaining the benefits of the present invention and without departing from the scope of the present invention.

In one embodiment, handle element central support member 288 is positioned in a slot or gap 294 extending between opposite, mirror-image sections of base spacer element 284. In one embodiment, the mirror-image sections of base spacer element 284 are adjoined such that a slot 294 extends therebetween, while in an alternative embodiment the mirror image sections are separate pieces spaced from one another to form a gap 294 between the sections of base element 284. A stop flange 295 is provided on a lower end of handle support member 288, and stop flange 295 cooperates with stop ridges 296 that project inwardly into slot or gap 294 from an upper periphery of respective sections of base spacer element 284. In an exemplary embodiment, a lateral dimension or thickness of handle support member 288 is slightly less than a lateral dimension of slot 294 so that handle support member 288 may slide upward and downward within slot 294 to extend or retract handle element 286 relative to base spacer element 284. Handle element support member 288 is guided within slot 294 as handle element 286 is positioned in the extended or retracted position.

In an exemplary embodiment, handle element 286 and base spacer element 284 of handle section 282 are each fabricated from known plastic materials according to known manufacturing methods and techniques, including but not limited to molding operations familiar to those in the art.

In the closed or retracted position illustrated in FIG. 10, handle gripping element 290 is substantially flush with an upper exterior surface 250 of fuse housings 32 and rests upon contoured uppers surface of each section of base spacer element 284. In the retracted position, flange stop 295 extends beneath, and is separated from, a lower surface 293 of base spacer element 284. In the extended position, handle support element 288 is moved upwardly within slot base element slot 294 and handle gripping element 290 is extended above top surfaces 250 of fuse housings 32. When handle support element flange stop 295 contacts stop ridges 296 of base element 284, flange stop 295 prevents handle element 286 from being removed from base element 284. Engagement of handle element stop flange 295 with base element ridges 296 further allows fuse 280 to be lifted or pulled from a fuse housing by pulling upward on handle element 286 when in the fully extended position.

In an exemplary embodiment, base spacer element 284 includes mounting through-holes 297 integrally formed therein and generally aligned with through-holes 298 in each of fuse covers 252 and extending through fuse housings 32 positioned on opposite sides of handle section 286. Known fasteners, such as fasteners 256 (shown in FIG. 9) extend through through-holes 297, 298 to securely couple handle section 282 to fuse housings 32 extending on opposite sides thereof. In further and/or alternative embodiments, other known attachment methods could be employed to secure handle section 282 to fuse housings 32, including but not limited to adhesive processes and ultrasonic welding processes.

Like fuse 202, fuse 280 includes LED 38 protruding through an opening in one of fuse housings 32 so that fuse state indication is readily ascertainable from visual inspection of LED 38. If LED 38 is not illuminated, fuse 280 is functional, i.e., fuse links 34 have not opened due to fault current conditions. On the other hand, if LED 38 is illuminated, fuse 280 has operated and should be replaced with a functional fuse. Remote fuse state indication is also incorporated via alarm terminal 42 (shown in FIG. 9) in conjunction with open fuse indication device 36 (shown in FIG. 9) as explained above.

Fuse 280 in combination with switch housing assembly 204 (shown in FIG. 8) provides a fused disconnect assembly that facilitates installation to existing equipment without auxiliary components or hand wired connections and is capable of higher current protection than, for example, assembly 10 (shown in FIG. 1). Switching is achieved by inserting or extracting fuse 280 with handle element 286 from switch housing fuse receptacle 210 (shown in FIG. 7), and local and remote opened fuse indication provides ready indication of opened fuses for replacement.

Figure 11:
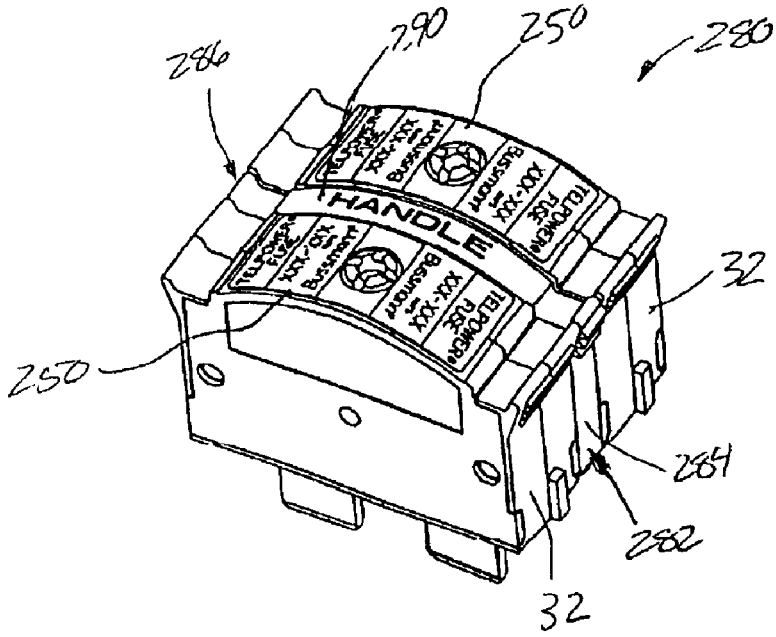
FIG. 11 is a perspective view of the fuse shown in FIG. 10 with the handle in a retracted position.

FIG. 11 is a perspective view of fuse 280 in a fully assembled state with handle section 282 secured to and extending in between fuse housings 32 and with handle element 286 in the closed or retracted position. In the closed or retracted position an upper surface of handle gripping element 290 is substantially flush with an upper exterior surface 250 of fuse housings 32. As such, the flush arrangement of handle element 286 provides an unobstructed area in the immediate vicinity of fuse 280 and handle element 286 is neatly tucked away between fuse housings 32.

As desired, handle element 286 may be opened from the closed position by gripping the lateral edges of handle gripping element 290 and pulling upward on handle element 286 to displace handle support member 288 (shown in FIG. 10) upwardly within slot 294 (shown in FIG. 10) extending in base spacer element 284.

Figure 12:
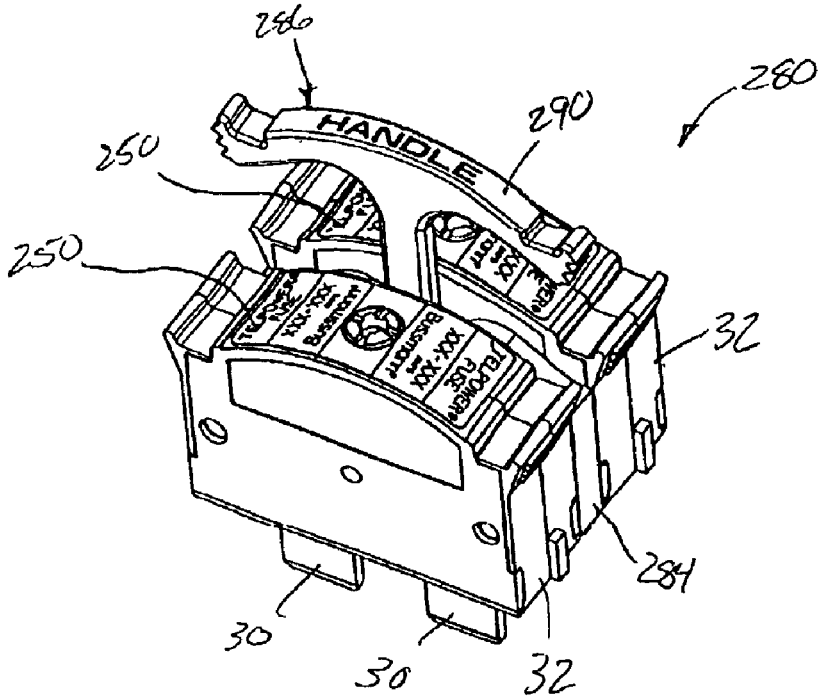
FIG. 12 is a perspective view of the fuse shown in FIG. 10 with the handle in an extended open position.

FIG. 12 is a perspective view of fuse 280 with handle element 286 in an extended open position. In the open position, handle support element 288 is moved upwardly within slot base element slot 294 and handle gripping element 290 is extended above top surfaces 250 of fuse housings 32. Handle support element flange stop 295 (shown in FIG. 10) is in contact with stop ridges 296 (also shown in FIG. 10) of base element 284, and engagement of handle element stop flange 295 with base element ridges 296 allows fuse 280 to be lifted or pulled from a fuse housing when handle element 286 is pulled further upward. As handle element 286 is pulled upwardly, fuse terminals 30 are disengaged from fuse terminal openings 54 (shown in FIG. 8) of, for example, switch housing 204 (also shown in FIG. 8).

As desired, handle element 286 may be returned to the closed or retracted position from the open position by depressing handle element 286 and displacing handle support member 288 (shown in FIG. 10) downwardly within slot 294 (shown in FIG. 10) extending in handle section base 284 until handle gripping element 290 is again flush with upper surfaces 250 of fuse housings 32.

Figure 13:
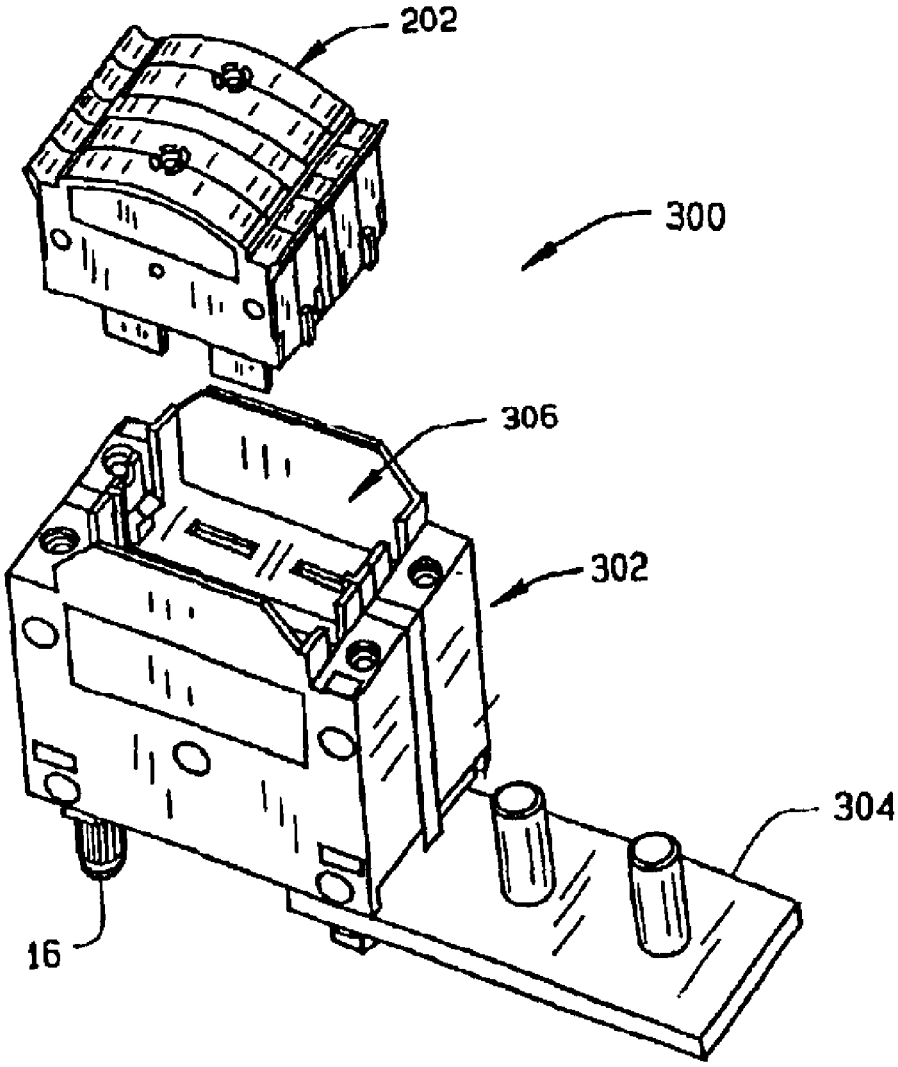
FIG. 13 is perspective view of a fifth embodiment of a switch housing assembly.

FIG. 13 is perspective view of another embodiment of a fused disconnect assembly 300 including fuse 202 and a switch housing assembly 302 coupled to a common output bus 304.

It may be recognized that switch housing assembly 302 is essentially a double-wide version of switch housing assembly 100 (shown in FIG. 5) to facilitate enhanced overcurrent protection in conjunction with fuse 202. Accordingly, switch housing assembly 302 includes a fuse receptacle 306, a pair of bullet contact assemblies 16 for line-side connection to external circuitry, and a pair of load-side terminal contact assemblies 102 (not shown in FIG. 13) that are connected to output bus 304. When fuse 202 is inserted into fuse receptacle 306, and further when bullet contact assemblies 16 are coupled to line-side connections, an electrical circuit is established through fuse 202 between each respective pair of bullet contact assemblies 16 and the terminal contact assemblies 102. The load may be disconnected by extraction of fuse 202 from switch housing assembly 306.

Figure 14:
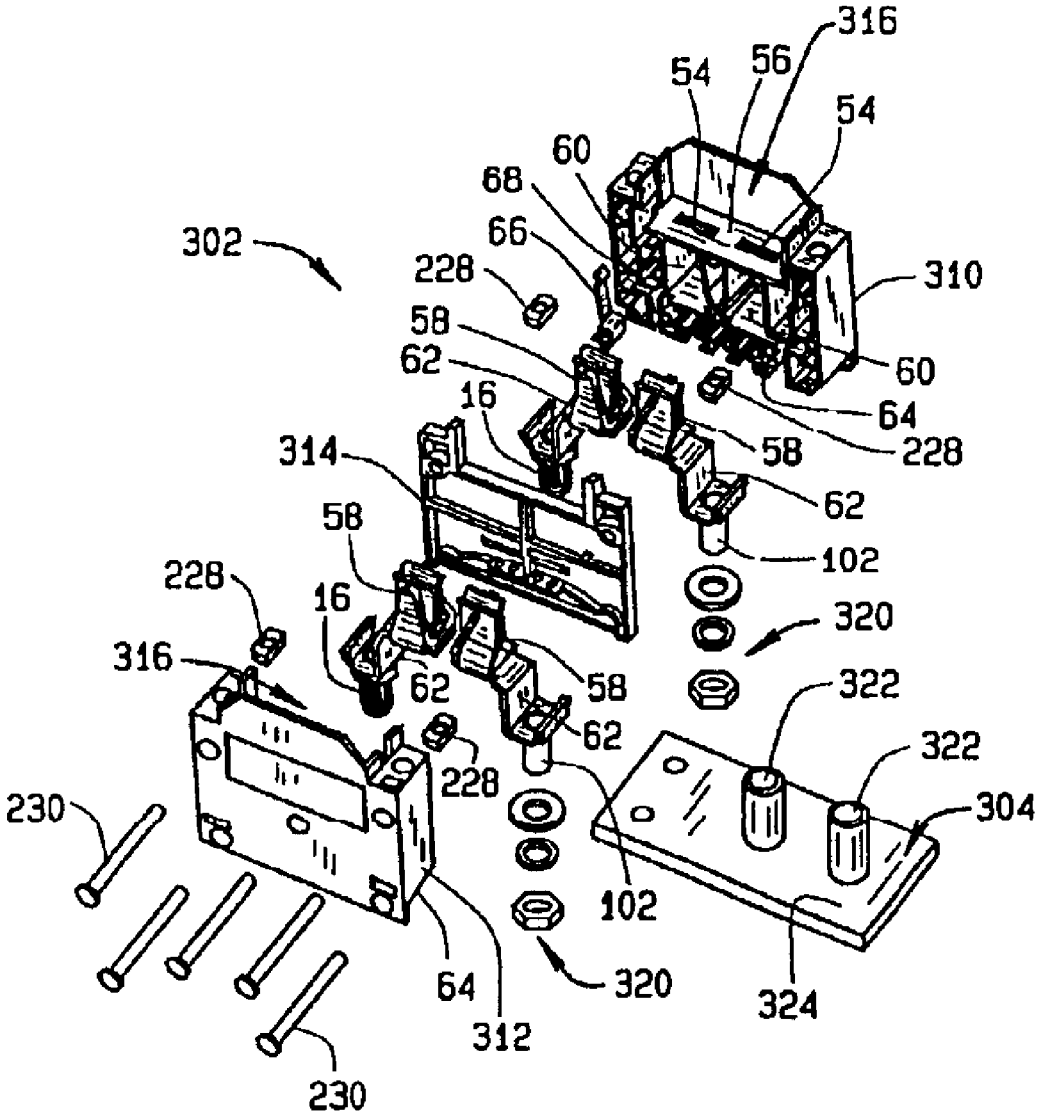
FIG. 14 is an exploded view of the switch housing assembly shown in FIG. 13.

FIG. 14 is an exploded view of a switch housing assembly 302 including substantially identical front and rear housings 310, 312 and a spacer element 314 located therebetween. Each housing 310, 312 includes fuse terminal openings 54 in a bottom 56 of a fuse receptacle 316 that forms approximately one half of fuse receptacle 306 (shown in FIG. 13) for receiving fuse terminal blades 30 (shown in FIG. 9). Electrically conductive resilient clips 58 are located below each fuse terminal opening 54 and located in cavities 60 below fuse receptacle 316. Bridge portions 62 extend downwardly from each clip 58 and to electrically conductive bullet contact assemblies 16 for line-side electrical connection, and also to electrically conductive terminal stud contact assemblies 102 for load-side electrical connections. When fuse terminals 30 (shown in FIG. 9) are inserted through fuse terminal openings 54, fuse terminals 30 are received in clips 58 and thus are electrically coupled to bullet contact assemblies 16 and to terminal stud contact assemblies 102 protruding through a bottom 64 of housings 310 and 312.

Switch housing internal alarm terminal 66 is positioned adjacent one of fuse clips 58 within an adjacent cavity 68 in housing 310, and includes a projecting ridge 70 (shown in FIG. 3) at a top end 72 (also shown in FIG. 3) that protrudes through an opening 74 (as shown in FIG. 3) in a side wall 76 (see FIG. 3) of fuse receptacle 310. Thus, when fuse 202 (shown in FIG. 13) is fully inserted into fuse receptacle 306 (shown in FIG. 13) that is jointly formed by receptacles 316 of each housing 310, 312, alarm terminal projecting ridge 70 contacts fuse alarm terminal 42 (shown in FIG. 9) through an opening in fuse housing 32 (similar to opening 44 shown in FIG. 2). Internal alarm terminal 66 is further coupled to a remote output alarm terminal (not shown in FIG. 14 but similar to terminal 78 shown in FIG. 5) that extends though a bottom 64 of switch housings 310 and 312, thereby completing an electrical path for an open fuse alarm signal for transmission to end use equipment (not shown) during an open fuse condition.

Mounting footings 228 are provided in each housing 310, 312 adjacent fuse receptacles 316, and known fasteners 230 are extended through openings in housings 310, 312 and spacer element 314 to secure assembly 302 in an assembled condition as shown in FIG. 13.

Output bus 304 is coupled to terminal stud contact assemblies 102 with known fasteners 320 and includes terminal stud connectors 322 extending from a top surface 324 of bus element 304.

Fuse 202 (shown in FIGS. 7 and 9) or fuse 280 (shown in FIGS. 10–12) in combination with switch housing assembly 302 provides a fused disconnect switch assembly 300 (shown in FIG. 13) that facilitates installation to existing equipment without auxiliary components or hand wired connections and is capable of higher current protection than a system utilizing switch housing assembly 100 (shown in FIG. 5). Switching is achieved by inserting or extracting fuse 202 from switch housing fuse receptacle 306 (shown in FIG. 13), and local and remote opened fuse indication provides ready indication of opened fuses for replacement. Because a variety of differently rated fuses are accommodated by switch housing receptacle 306, a versatile fused disconnect system 300 is provided that is suitable for a wide variety of applications.

It is recognized that system 300 could be further extended to obtain even greater amperage ratings, e.g., a triple-wide fuse and switch housing assembly could be employed.

Figure 15:
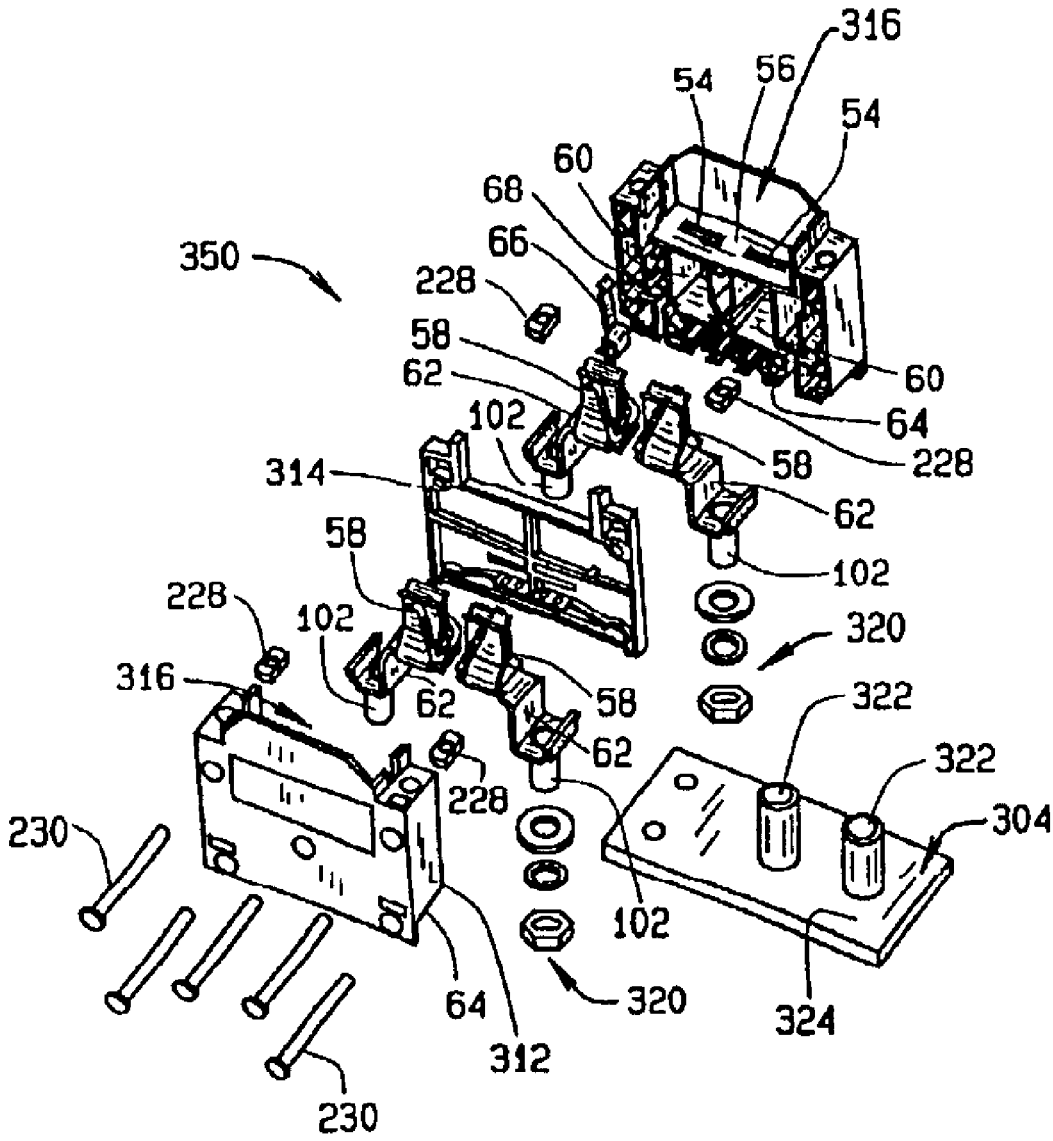
FIG. 15 is an exploded view of a sixth embodiment of a switch housing assembly.

FIG. 15 is an exploded view of a yet another embodiment of a switch housing assembly 350 similar to switch housing assembly 302 (shown in FIG. 14). Switch housing assembly 350 is substantially similar to switch housing assembly 302 with the exception of terminal stud contact assemblies 102 are employed to form both line-side and load-side electrical connectors. In other words, bullet contact assemblies 16 (shown in FIG. 14) are replaced with terminal stud contact assemblies 102. For ease of reference, common features of assembly 350 and assembly 302 are indicated with like reference characters.

Figure 16:
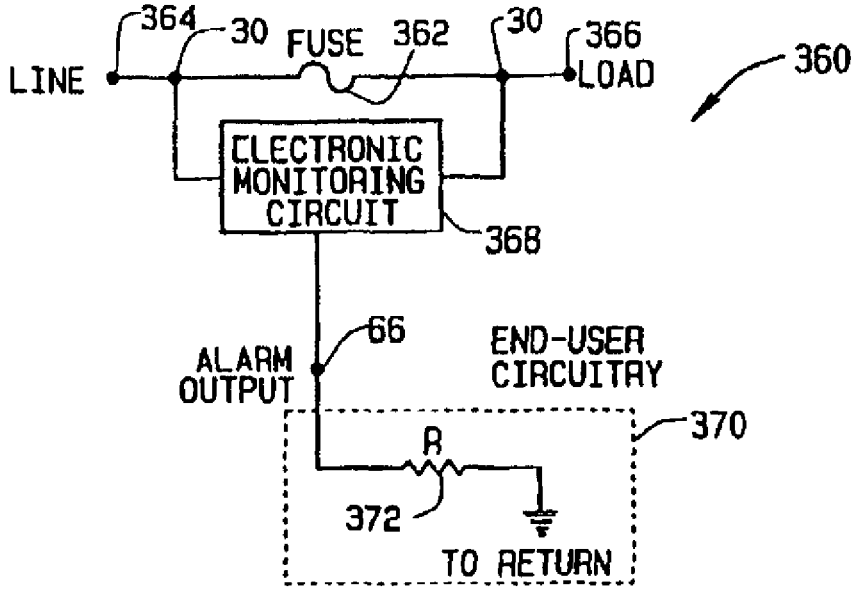
FIG. 16 is an alarm circuit schematic for the fuses shown in FIGS. 1, 2, 7, 9 and 12.

FIG. 16 schematically illustrates an alarm circuit 360 for a fuse 362, such as fuse 12 (shown in FIGS. 1 and 2), fuse 202 (shown in FIGS. 7, 9 and 10), or fuse 280 (shown in FIGS. 10–12). Fuse terminals 30 (shown in FIGS. 1, 2, 7 and 10) are connected to line and load circuitry of the end use application at points 364 and 366 through applicable terminal contact portions of a switch housing assembly, such as those described above. An electrical circuit is therefore established through fuse link(s) 34 (shown in FIGS. 2 and 9) and through an electronic monitoring circuit 368 formed on printed circuit board 262 (shown in FIG. 9) of open fuse indication device 36 (also shown in FIG. 9). Electronic monitoring circuit 368 has a sufficiently high resistance so that in normal operation of fuse 362 substantially all of the current flowing through the fuse passes through fuse link 34.

When fuse link 34 opens in a current overload or short circuit condition, electronic monitoring circuit 368 detects a voltage drop across terminals 30 and illuminates LED 38, as well as outputs an alarm signal through alarm terminal 42 (both shown in FIGS. 2 and 9) to a remote output alarm terminal 66 of a switch housing assembly, such as those described above. Alarm terminal output 66 is coupled to end-user circuitry 370 that in an illustrative embodiment, includes a relay 372 that may be used to identify a location of an operated or opened fuse 362 in a system employing a large number of fuses in various locations. In one embodiment, a load side of LED 38 is connected to output alarm terminal 66, thereby supplying 20 mA current to relay 372 for remote fuse state indication. Thus, as LED 38 is energized, a remote alarm signal is also sent through output alarm terminal 66.

Figure 17:
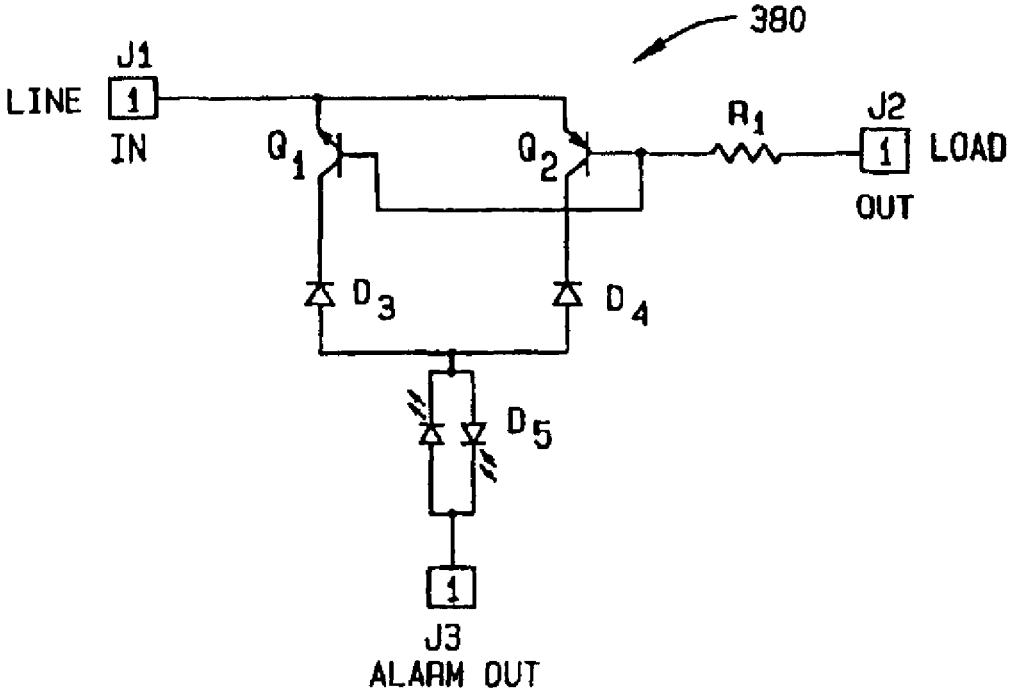
FIG. 17 is one embodiment of an alarm circuit for the schematic shown in FIG. 16.

FIG. 17 illustrates an exemplary electronic monitoring circuit 380 for alarm circuit 368 (shown in FIG. 16). Terminal J1 is coupled to the line or input side of the fuse, and more specifically, to fuse terminal posts 258 (shown in FIG. 9) that is associated with-line side circuitry of the fuse application. Terminal J2 is coupled to the load or output side of the fuse, and more specifically, to fuse terminal post 258 (shown in FIG. 9) that is associated with load side circuitry of the fuse application. Terminal J3 is electrically connected through an appropriate impedance to the return or common electrical ground of the fused circuit. A pair of matched transistors, namely an NPN transistor Q1 and a PNP transistor Q2 are employed with diodes D3, D4 to prevent current leakage (about 1.2 mA in one embodiment) through respective transistors Q1, Q2, Therefore, diodes D3, D4 prevent false fuse state indication resulting from low base emitter voltage of transistors Q1 and Q2, and further provide transient immunity for electronic monitoring circuit 368 arc-voltage during operation of the fuse. A bipolar LED 38 (indicated by D5 in FIG. 17 and also shown in FIG. 9) is coupled to transistors Q1, Q2 and terminal J3.

In normal operation, electronic monitoring circuit 368 is a passive component, i.e., active components of electronic monitoring circuit are non-conducting and voltage drop across terminals J1 and J2 is negligible. Consequently, LED 38 is not illuminated and stress on the circuit components is primarily thermal. However, after an overload or short-circuit condition in the fused circuit causes fuse 202, or more specifically fuse links 34 to operate, the resultant voltage drop across terminals J1 and J2 causes either transistor Q1 or Q2, depending upon system voltage polarity, to saturate and actively conduct to energize LED 38.

More specifically, in case of positive system voltage, full system voltage is impressed across terminals J1 and J2 when fuse links 34 have opened, thereby forward biasing a base-emitter junction of PNP transistor Q2 through resistor R1. In this condition, as the base-emitter junction voltage is greater than an associated minimum forward bias voltage, a transistor collector-emitter junction of PNP transistor Q2 saturates and the system voltage is applied across LED 38, thereby illuminating the LED.

In case of a negative system voltage, full system voltage is impressed across terminals J1 and J2 when fuse links 34 have opened, thereby forward biasing a base-emitter junction of NPN transistor Q1 through resistor R1. In this condition, as the base-emitter junction voltage is greater than an associated minimum forward bias voltage, a transistor collector-emitter junction of NPN transistor Q1 saturates and the system voltage is applied across LED 38, thereby illuminating the LED.

Appropriate selection of resistor R1 ensures saturation of transistors Q1, Q2 under positive and negative voltage conditions. Saturation of transistors Q1, Q2 electronically switches the line or input side of the fuse at terminal J1 in series with the alarm output terminal J3, thereby illuminating the bipolar LED 38 to locally indicate the presence of an open-fuse condition. For remote open-fuse alarm indication, terminal J3 is connected to the return or common electrical ground of the fused circuit through a device such as a relay as illustrated in FIG. 16. When an open-fuse condition exists, the electronic monitoring circuit 368 will cause the relay to change state and provide the ability to remotely identify the presence of the open-fuse condition.

In a particular embodiment, transistors Q1 and Q2 have a voltage rating of at least 200 VDC to ensure proper operation of electronic monitoring circuit at system voltages of 80 VDC. In addition, a base current of at least about 100 $\mu$A is required in one embodiment for transistors Q1, Q2 to function properly. Still further, in one embodiment, utilizing a minimum turn on voltage of 18 VDC, resistor R1 has a value of about 59 Kohms, thereby resulting in a base current of about 300 $\mu$A.

While the invention has been described in terms of various specific embodiments, those skilled in the art will recognize that the invention can be practiced with modification within the spirit and scope of the claims.

What is claimed is:

1. A fuse comprising:

a fuse housing;

at least one primary fuse link extending within and enclosed by said fuse housing;

at least a pair of fuse terminals mechanically and electrically connected to said at least one primary fuse link, said pair of fuse terminals extending from said fuse housing; and a retractable handle assembly coupled to said fuse housing, said handle assembly comprising a base spacer element and a handle element extending into said base spacer element, said handle element selectively positionable relative to said base spacer element, said handle element comprising a stop flange, said base spacer element comprising at least one stop projection therein, said stop flange contacting said stop projection when said handle is in an open position.

2. A fuse in accordance with claim 1 wherein said fuse housing comprises a first fuse housing and a second fuse housing, said handle assembly extending between said first fuse housing and said second fuse housing.

3. A fuse in accordance with claim 1, said fuse housing comprising a top surface, said handle assembly comprising a handle element comprising a top surface, said top surface of said handle element substantially flush with said top surface of said housing when said handle assembly is in a closed position.

4. A fuse comprising:

a housing assembly;

a first primary fuse link and a second primary fuse link extending within said housing assembly, each of said first primary fuse link and said second primary fuse link coupled to a pair of fuse terminals extending from said housing assembly, said first primary fuse link and said second primary fuse link extending in parallel between each respective pair of fuse terminals; and a handle assembly coupled to said housing assembly, said handle assembly comprising a handle element and a base element coupled to said housing assembly, said handle element selectively positionable relative to said base element between a retracted position wherein said handle element is substantially flush with a top surface of said housing assembly and an extended position wherein said handle element is separated from said top surface of said housing assembly.

5. A fuse in accordance with claim 4 wherein each of said pair of fuse terminals comprises blade terminals extending from a bottom surface of said housing assembly.

6. A fuse in accordance with claim 4 wherein said base element comprises a slot therein, said handle element extending into said slot.

7. A fuse in accordance with claim 6, said handle element comprising a stop flange, said slot comprising at least one stop projection therein, said stop flange contacting said stop projection when said handle is in an open position.

8. A fuse in accordance with claim 4 further comprising an open fuse indication device within said housing assembly.

9. A fuse in accordance with claim 8 wherein said fuse further comprises a remote output alarm terminal in communication with said open fuse indication device.

10. A fuse in accordance with claim 8 wherein said open fuse indication device comprises a high resistance electronic circuit.

11. A fused disconnect switch comprising:

at least one switch housing assembly comprising a fuse receptacle and a plurality of fuse terminal contact assemblies extending therefrom, at least one of said plurality of fuse contact assemblies comprising a bullet contact assembly; and a retractable fuse comprising a fuse housing comprising at least one primary fuse link extending therein and at least one handle element attached to said fuse housing;

wherein said handle element is selectively positionable relative to said fuse housing between a retracted position wherein said handle element is substantially flush with a top surface of said fuse housing and an extended position wherein said handle element is separated from said top surface of said fuse housing.

12. A fused disconnect switch in accordance with claim 11 wherein said fuse further comprises an open circuit indication device within said fuse housing.

13. A fused disconnect switch in accordance with claim 11 wherein said plurality of terminal contact assemblies comprises at least one bullet contact assembly.

14. A fused disconnect switch in accordance with claim 11, wherein at least one of said plurality of contact assemblies comprises a terminal stud contact assembly.

15. A fused disconnect switch comprising:

a switch housing comprising a fuse receptacle, first and second line-side contact assemblies extending from said fuse receptacle, and first and second load-side contact assemblies extending from said fuse receptacle; and a fuse comprising a fuse housing assembly, a first primary fuse link extending within said fuse housing assembly between said first line-side contact assembly and said first load-side contact assembly, a second primary fuse link extending within said fuse housing assembly between said second line-side contact assembly and said second load-side contact assembly, said first and second line-side contact assembly and said first and second load-side contact assembly each comprising a blade terminal extending from a bottom surface of said fuse housing assembly, and a retractable handle element coupled to said fuse housing assembly.

16. A fused disconnect switch in accordance with claim 15, said first and second line side contact assembly comprising a bullet contact assembly.

17. A fused disconnect switch in accordance with claim 15, said first and second load-side contact assembly comprising a terminal stud contact assembly.

18. A fused disconnect switch in accordance with claim 15 further comprising a common bus coupled to first and second load-side contact assembly.

19. A fused disconnect switch in accordance with claim 15, said fuse further comprising an electronic monitoring circuit.

20. A fuse comprising:

a housing assembly comprising a first fuse housing and a second fuse housing;

at least one primary fuse link extending within said housing assembly;

at least a pair of fuse terminals connected to said at least one primary fuse link, said pair of fuse terminals extending from said housing assembly; and a retractable handle assembly coupled to said housing assembly and extending between said first fuse housing and said second fuse housing, said handle assembly comprising a base spacer element and a handle element extending into said base spacer element, said handle element selectively positionable relative to said base spacer element.

21. A fuse comprising:

a first housing;

a first primary fuse link extending within said housing;

a pair of fuse terminals associated with said first primary fuse link and extending from said first fuse housing;

a second housing;

a second primary fuse link extending within said second housing;

a pair of fuse terminals associated with said second primary fuse link and extending from said second housing; and a handle assembly extending between and coupled to said first housing and to said second housing, said handle assembly comprising a retractable handle element and a base spacer element comprising a slot therein, said handle element slidably positionable within said slot.

22. A fuse in accordance with claim 21 wherein said handle assembly comprises a retractable handle element.

* * * * *